United States Patent [19]

Bear

[11] Patent Number: 4,949,520

[45] Date of Patent: Aug. 21, 1990

[54] MODULAR COMPONENTIAL SYSTEM FOR ASSEMBLING VARIOUS BUILDING INTERIOR FACADE STRUCTURES

[76] Inventor: Richard W. Bear, 510 Merrybrook Ct., Clemmons, N.C. 27012

[21] Appl. No.: 351,457

[22] Filed: May 9, 1989

[51] Int. Cl.[5] ..... E04D 1/36; E04C 1/39

[52] U.S. Cl. ..... 52/288; 312/245; 312/204; 312/297

[58] Field of Search ..... 52/287, 594, 588, 587, 52/586, 585, 288; 312/297, 204, 245

[56] References Cited

U.S. PATENT DOCUMENTS 3,959,830 6/1976 Van Den Broek ..... 52/288

3,999,824 12/1976 Pearsons ..... 312/245

4,150,517 4/1919 Warner ..... 52/288

*Primary Examiner*—John E. Murtagh

*Attorney, Agent, or Firm*—Simmons, Perrine, Albright & Ellwood

[57] ABSTRACT

A componential system for assembling various interior building facade structures such as soffits and other decorative or functional installations feature a number of modular components extruded and molded from suitable poly-plastic material which can be snapped together, placed in position and afterwards finished in any desired manner, as by painting or papering. No drywalling or like work or other construction is necessary so that soffits, for instance, can be assembled and installed by the cabinet or other installer rather than by carpenters and drywallers, as is typical.

14 Claims, 4 Drawing Sheets

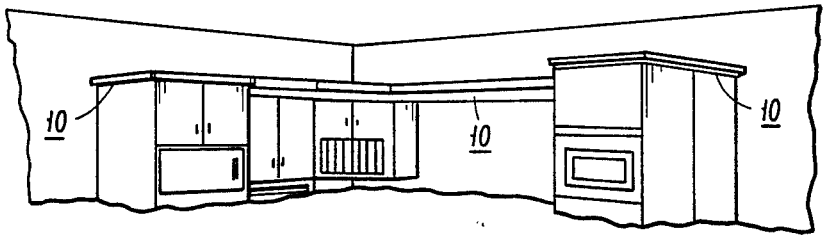
FIG 1
FIG 2
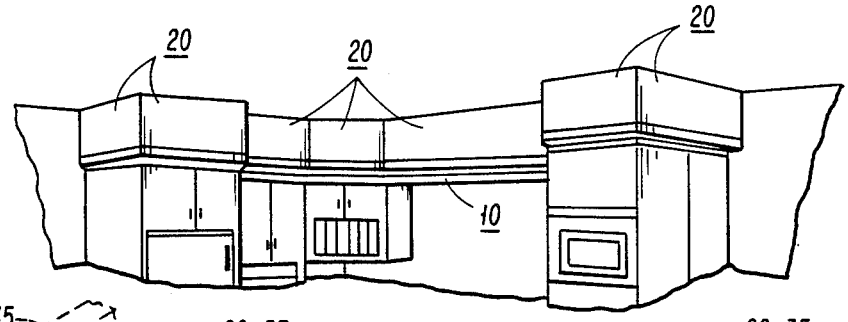
FIG 4
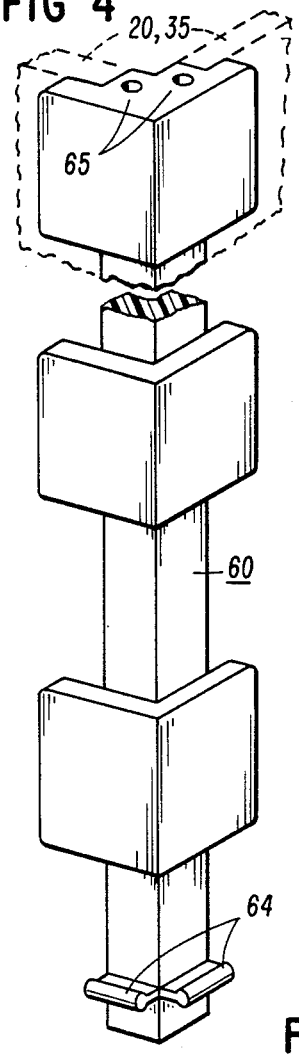
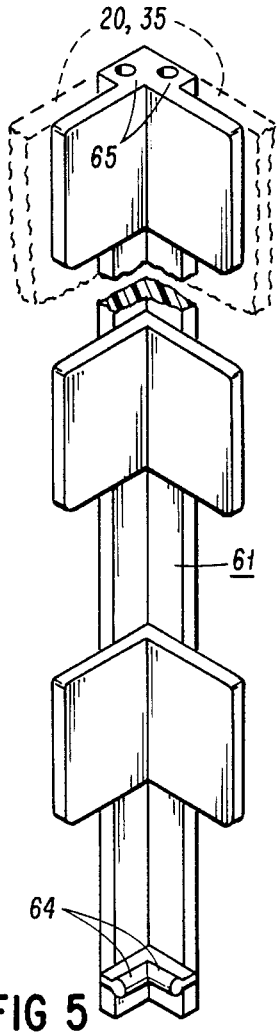
FIG 5
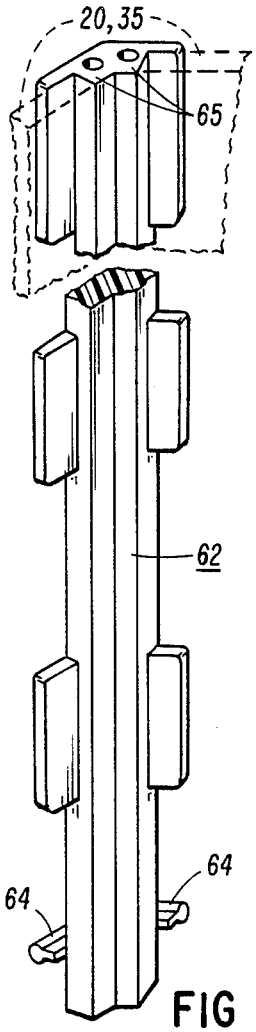
FIG 6
FIG 7
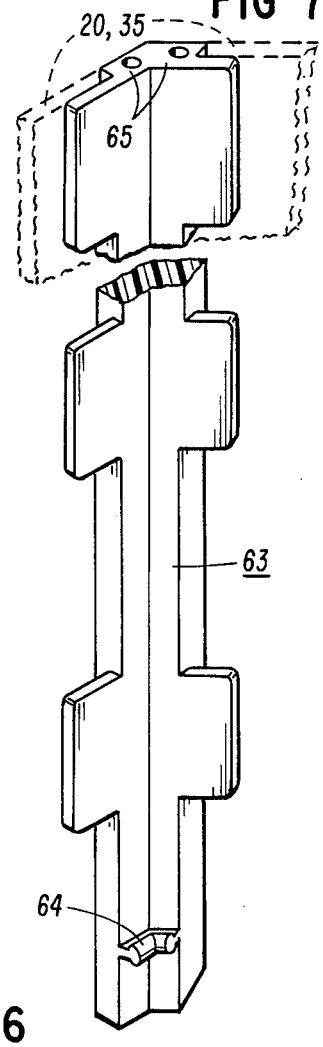

10
11
12
13
14
15
16
17
18
20
21
22
23
30
31
35
36
37
38
40
41
42
43
44
45
46
50
51
55
56
57
58
59
70
71

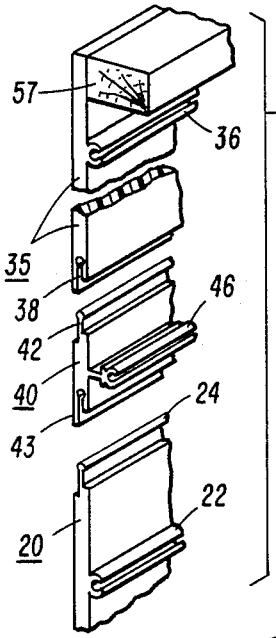
FIG 11
FIG 12
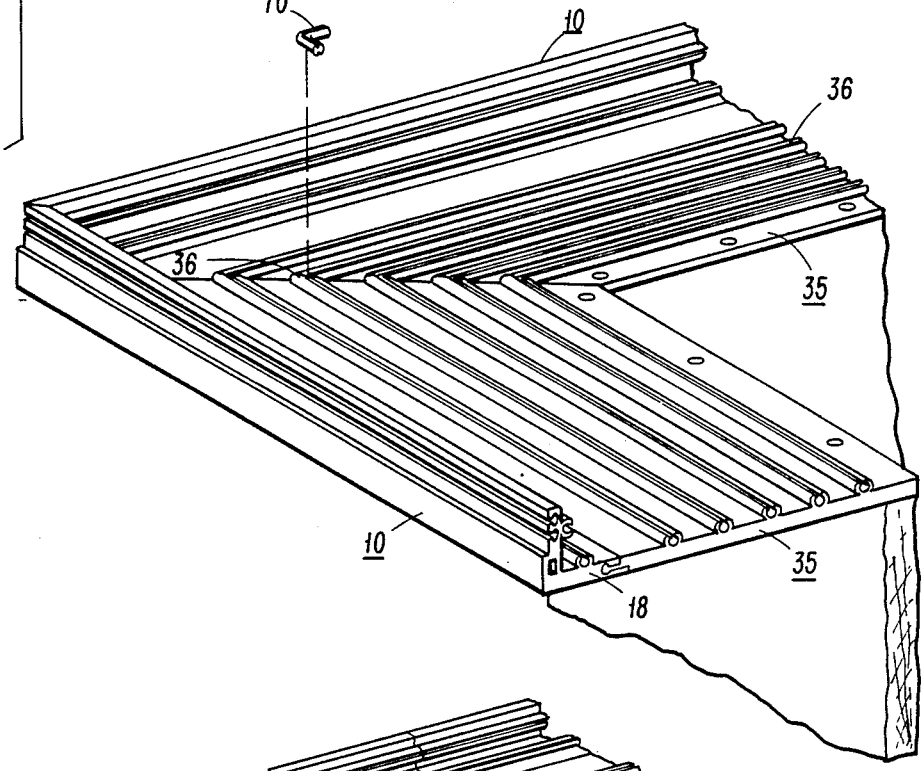
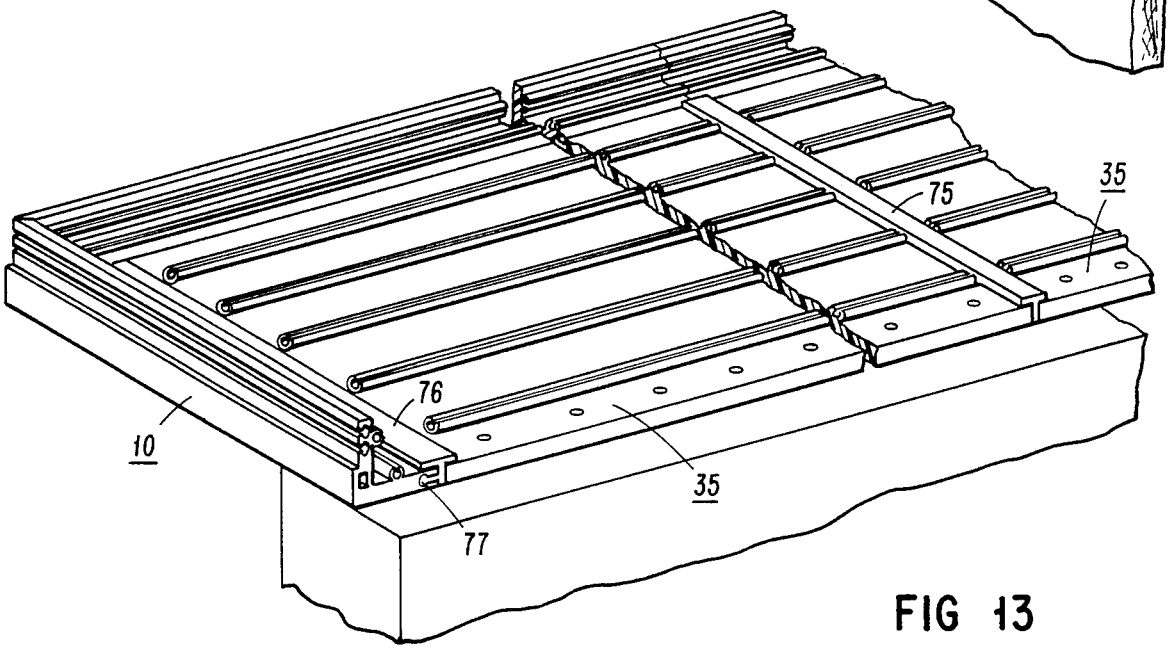
FIG 13

MODULAR COMPONENTIAL SYSTEM FOR ASSEMBLING VARIOUS BUILDING INTERIOR FACADE STRUCTURES

BACKGROUND OF THE INVENTION

The present invention concerns interior soffits and other functional and decorative facade structures, particularly a system of modular components by which the same can be readily installed.

Traditionally, soffits, for instance in kitchens, bathrooms and the like, are fabricated on the job by the carpenters and dry-wall artisans responsible for the construction of the basic room, which is to say, before the installation of the cabinets below them. Because of that, problems frequently arise owing to poor communication or misunderstanding between the framers of the room and the soffits, on the one hand, and the designer of the kitchen, for instance, and/or the installer of its cabinets and other equipment, on the other hand. Inaccuracies in construction, when soffits are built in this manner, also often occur and are difficult and costly to correct. That is left to the cabinet installer to do later by the use of spacers or shims, for instance, or make makeshift remedies which frequently result in a less than acceptable finished product. Even the preformed soffits of my prior U.S. Pat. Nos. 4,584,807 and 4,704,833, though they are better than typical framed-up soffits, can suffer since they are put in place by the carpenter and covered by the dry-waller. Indeed, so common and so nagging are the problems with soffits installed in the traditional manner that some builders and designers discourage their use altogether because of the labor and material costs involved not only in their construction but also in correcting their shortcomings.

So the primary object of the present invention is to provide for the installation of soffits and other interior facade structures in a manner which avoids the problems and deficiencies recounted above.

Another object is the provision of a system of modular components by which soffits and other interior facades of various sizes can be readily and accurately installed.

A further object is the provision of a system of modular components by which various decorative soffit and other structural facade designs can be readily created.

A still further object is to accomplish the foregoing with minimum requirement of labor and skill on the part of those involved in the construction concerned.

SUMMARY OF THE INVENTION

The objects of the invention are achieved essentially by a system by which facades such as soffits, for instance, are installed after the cabinets and other equipment have been fitted in the room concerned and by the very same persons who do that fitting. This is rendered possible by assembling the soffits and other facades from a collection of extruded and molded plastic components of modular design so that most any situation can be accommodated. No framing materials, framing, or dry-wall technique is necessary. A large number of decorative designs can also be incorporated into the soffits and other facades by the architect or the kitchen creator or whoever is responsible for the decorative aspects of the room involved. Indeed, since the carpenters and drywallers are not involved in the construction of the soffits and other facades, the decorator of the room and/or the cabinet installer can alter a previous design or create a new design on the spot before or after the cabinets are installed, something impossible in the case of traditionally constructed soffits. For instance, the designer might elect at the last moment to use a cove ceiling-type soffit instead of a true vertical or straight soffit. In short, so flexible and adaptable are the components of the invention that, armed basically with nothing more than tape measure, saw, straight edge, screw driver and pencil, the installer can produce professionally appearing, accurate and decorative soffits and other facades without any of the problems so often encountered in doing so, all with less labor and materials and at less cost.

The modular components of the soffits and other facades, which consist of a few basic items plus various connectors and braces, are shipped from the factory to the cabinet vendor, to the kitchen or bath designer, or to the manager of those departments of a building products supplier, and can be displayed along with various decorative possibilities in the showroom. They can be easily and economically stored in vertical bins much as baseboard and door moldings and the like are stored and displayed. The surfaces of the components are preprimed and ready for final painting or wallpapering. In more deluxe instances the surfaces can have an orange peel, wood grain or glossy lacquer texture or finish. Other and further features and advantages of the present invention will become apparent from the drawings and the more detailed description which follows.

BRIEF DESCRIPTION OF THE DRAWINGS

FIG. 1 depicts a corner of a kitchen, for example, along whose walls are installed various cabinets, the tops of which are fitted with a decorative facade formed by one of the basic modular components of the invention.

FIG. 2 is similar to FIG. 1 and illustrates the installation above the cabinets of soffits formed by two of the basic modular components of the invention.

FIGS. 4 and 5 are perspective illustrations of the modular 90° panel outside and inside corner connections employed in the soffits of FIG. 2.

FIGS. 6 and 7 are perspective illustrations of the modular 45° panel outside and inside corner connectors employed in the soffits of FIG. 2.

FIG. 11 is a perspective view illustrating how the modular vertical panels are extended in height in necessary.

FIG. 12 depicts the manner in which the modular vertical/horizontal panels of the invention are joined at a right angle.

FIG. 13 shows the way in which the modular vertical/horizontal panels of the invention are joined end-to-end.

Figures 3, 3A, 8, 9, 10:
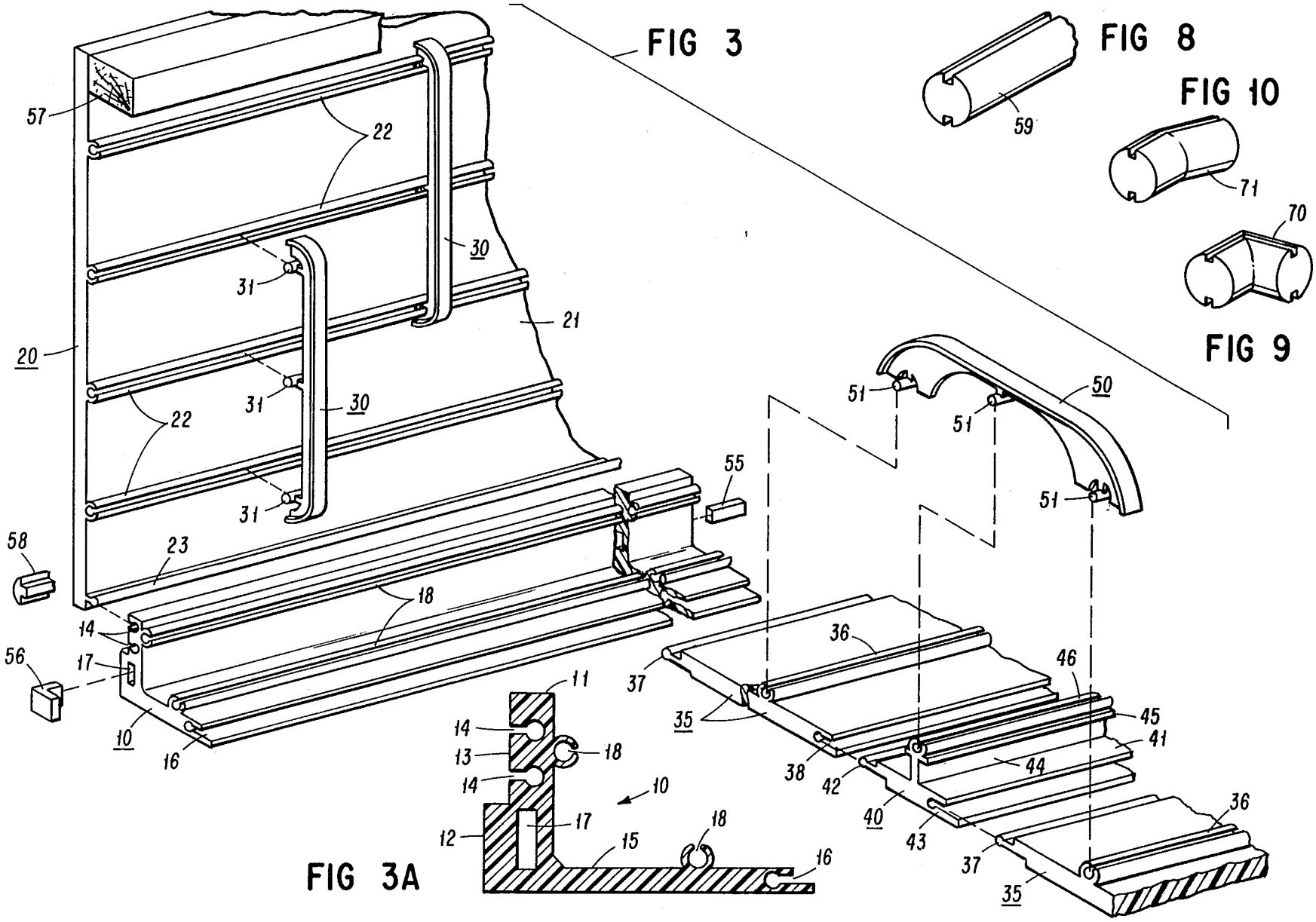
FIG. 3 is a partial view in perspective of several of the basic modular components of the soffits of FIG. 2 illustrating the manner of their assembly.
FIG. 3A is a cross-sectional view of the modular base plate of the invention.
FIGS. 8–10 are enlarged perspective views of the modular 90°, 45°, and straight butt-end connectors used in the soffits of FIG. 2.
Figure 14:
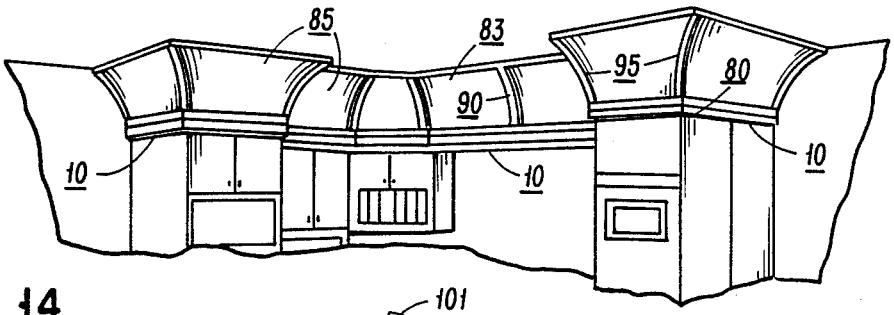
FIG. 14 is similar to FIG. 2 but illustrates another design of soffits that can be accomplished by the invention.
Figure 17:
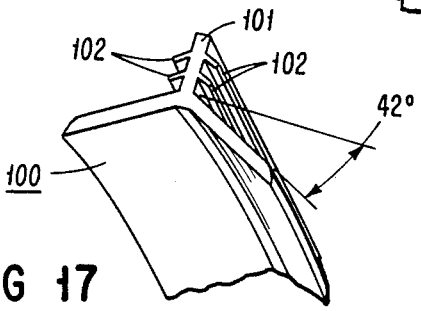
FIGS. 16 and 17 are perspective views of the modular partition strips employed in the soffits of FIG. 14.
Figure 16:
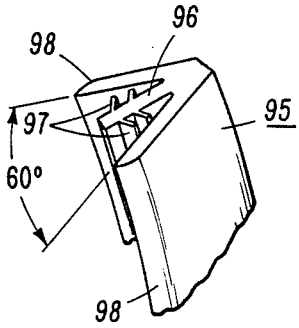

DETAILED DESCRIPTION OF THE PREFERRED EMBODIMENTS a. Basic Components

As mentioned, FIGS. 1 and 2, illustrate two arrangements of kitchen cabinets employing one of the basic modular components of the invention, namely the "base plates" 10 illustrated in detail in FIGS. 3, 3A, 12, 13 and 15. These consist of essentially L-shaped in cross section, integral extrusions having an upright leg 11, the upper portion of whose outer face 12 is provided with a shouldered inset 13 having a pair of vertically spaced, parallel sockets 14 cylindrically enlarged at their inner ends. The outer end of the horizontal leg 15 is shaped as shown and provided with a similar socket 16. A rectangular slot 17 is located rearward of the outer face 12 and outstanding from the adjacent inner faces of the legs 11 and 15 are a pair of parallel sockets 18. The inset 13 and the sockets 14, 16 and 18 and the slot 17 all extend longitudinally the full length of the base plates 10 and are extruded therewith.

The next basic component are the rectangular "vertical panels" 20, also integral extrusions, and of the same thickness as the depth of the base plate inset 13. The inner face 21 of each panel 20 is provided with several equally spaced, outstanding sockets 22 like the base plate sockets 18. The lower edge of the face 21 includes a tongue 23, cylindrically enlarged as shown at its outer end, which extends at right angles from the face 21 and is snappingly engagable with either of the base plate sockets 14. The upper edge of the panel 20 is formed with a similar tongue 24 but extending in the plane of the panel 20, as shown in FIG. 11. As in the case of the base plates 10, the panel sockets 22 and the tongues 23 and 24 extend longitudinally the full length of the panel 20 and are extruded therewith. In order to stiffen the panels 20 a number of molded, elongated panel braces 30 are provided of generally T-shape in cross section and equipped at one longitudinal edge with three short, transverse tongues 31, cylindrically enlarged at their outer ends, and shaped and spaced to snappingly engage the sockets 22 of the vertical panels 20, as shown in FIG. 3.

Another basic component are the rectangular "vertical/horizontal panels" 35 shown in FIGS. 3 and 11–13. Each panel 35 is substantially identical in width and nature to the vertical panels 20 and includes a like number of outstanding sockets 36 on its inner face of the same spacing and a tongue 37 like the tongues 24. The difference is in the opposite edge which, instead of the tongue 23, is provided with a socket 38 like the sockets 16 of the base plates 10. In order to join a vertical/horizontal panel 35 to a vertical panel 20 when necessary to get sufficient height and at the same time sufficient rigidity, as shown in FIG. 11, "I-beam connectors" 40 are provided which are also integral extrusions. The I-beam connectors 40 include a short base 41 having a tongue 42 along one edge snappingly engagable with the sockets 38 of the vertical/horizontal panels 35, as shown in FIGS. 3 and 11, and a socket 43 snappingly engagable with the tongues 24 of the vertical panels 20 or with the tongues 37 of other vertical/horizontal panels 35, as also shown in FIGS. 3 and 11. The webs 44 of the I-beam connectors 40 extend from inner faces of the bases 41 and are topped by narrow ledges 45 from which outstands like sockets 46. The junctions of the I-beam connectors 40 between a pair of vertical/horizontal panels 35, as shown in FIG. 3, or between a vertical panel 20 and a vertical/horizontal panel 35, as shown in FIG. 11, are stiffened by arcuate, molded panel connector braces 50 shown in FIG. 3. These are similar to the panel braces 30, being generally T-shaped in cross section and include three short, transverse tongues 51, the end ones of which are snappingly engagable with the adjacent sockets 36 of a pair of vertical/horizontal panels 35, as shown in FIG. 3, or with the sockets 22 and 36 of a vertical panel 20 and a vertical/horizontal panel 35, in the case of FIG. 11, the middle tongue 51 snappingly engaging the I-beam socket 46.

b. Assemblv

Should only a decorative facade along the upper edges of the cabinets be desired, as in FIG. 1, the base plates 10 alone are used. They are simply nailed or screwed to the upper surface of the cabinets and may be joined end-to-end by the use of short rectangular butt-end connectors 55 shown in FIG. 3 which engage the base plate sockets 17. If a 90° corner is involved, the ends of a pair of base plates 10 are mitered appropriately, as shown in FIGS. 12 and 13, and joined by 90° butt-end connectors 56, also shown in FIG. 3. A 45° corner, of course, would use a 135° butt-end connector (not shown). The insets 13 of the base plates 10 are then filled with any kind of decorative stripping, metal, wood, and so forth, of any desired finish.

If a true soffit is wanted the vertical panels 20 are employed. The distance from one of the base plate sockets 14 to the ceiling is measured and the panels cut to the proper width if necessary. The panel braces 30 are then applied, the panel tongues 23 snapped into the selected one of the sockets 14, and the upper edges of the panels 20 secured to a furring strip 57, for instance, fixed to the ceiling, all as shown in FIG. 3. If the lower sockets 14 are selected, the outer faces 12 of the legs 11 and the panels 20 present an unbroken, co-planar surface. If the panels 20 are not wide enough to span the distance to the ceiling, the vertical/horizontal panels 35 are used in conjunction, if necessary, with the I-beam connectors 40 and braces 50, as shown in FIG. 11. When the base plate upper sockets 14 are chosen for securing the lower edges of the panels 20, the resulting gap can then be filled by a decorative molded strip 58, as shown in FIG. 3. If it is necessary to join panels 20 end-to-end (and/or panels 35 end-to-end) in order to lengthen them, the respective abutting ends are bridged by molded, cylindrical butt-end connectors 59 shown in FIG. 8, which snap into the aligned sockets 22 and 36 of the panels 20 and 35.

Vertical corners are handled by the molded corner connectors 60–63 shown in FIGS. 4–7, the connectors 60 and 62 being for inside 90° and 45° corners, respectively, while the connectors 61 and 63 are for outside 90° and 45° corners, respectively. The placement of the panels 20 or 35 on the connectors 60–63 is indicated by broken lines in those Figures. The lower ends of the connectors 60–63 are provided with short integral tongues 64 which snap into the chosen one of the base plate sockets 14 and their upper and lower ends include a pair of holes 65 (only the upper ones being shown in the drawings) so that two corner connectors can be pinned together end-to-end to extend their height, if necessary.

Should it be desired that the base plates 10 be disposed forward of the cabinets so that the soffits overhang the latter, the vertical/horizontal panels 35 are employed in conjunction with the base plates 10. The panels 35 are trimmed to the width desired (if necessary) and then nailed or screwed to the top of the cabinets, as indicated in FIGS. 12 and 13, and the base plates 10 attached to the panels 35 using the tongues 37 of the latter and the sockets 16 of the base plates 10, as shown in FIGS. 12 and 13. In order to stiffen the joints between the base plates 10 and the panels 35, as well as the latter themselves, one end of the panel braces 30 are then snapped into the base plate sockets 18 on the horizontal legs 15 and other braces 30 along the panels 35 in the manner shown in FIG. 3 in connection with the vertical panels 20. In the case of a mitered corner shown in FIG. 12, the abutment between panels 35 are joined by molded cylindrical 90° butt-end connectors 70 (see FIGS. 9 and 12) which snap into the abutting panel sockets 36. Similar molded butt-end connectors 71 (see FIG. 10) are used for a 45° corner. Where two panels 35 must be employed end-to-end or to bridge a space over a sink or refrigerator, for instance, the extruded T-connectors 75 shown in FIG. 13 are used. And also in the case of FIG. 13 should the end of a panel 35 abut along a base plate 10, an extruded butt-connector 76 is employed having a tongue 77 which snappingly engages the sockets 16 of the base plate 10. If still greater depth is required, as over a sink or refrigerator, other panels 35 can be laterally joined to each other using the I-beam connectors 40 and braces 50, as shown in FIG. 3. The T-connectors 75 are also used in that case when abutting panels 35 end-to-end.

In those instances in which the respective ends of the sockets 36 would impede the insertion of the T-connectors 75 or the butt connectors 76, as in the case of FIG. 13, the ends of the sockets 36 are simply cut back. And if a socket 22 or 36 should impede fastening a panel 20 or 35 to a furring strip 57, it is simply removed. It is also recommended that a suitable adhesive be used on all joints as the various components are assembled.

c. Alternate Embodiments

Figure 15:
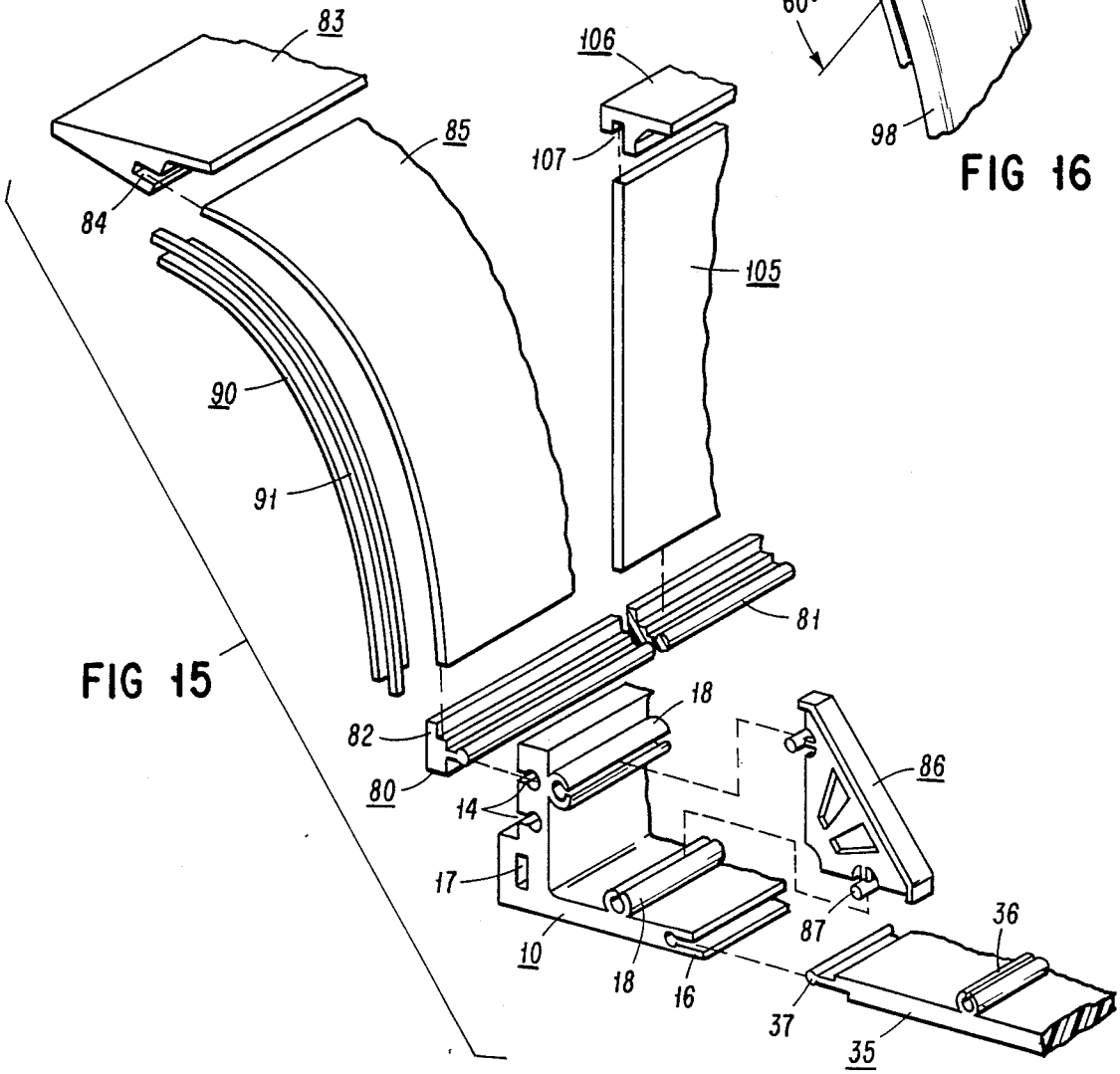
FIG. 15 is a partial view in perspective of the modular components of the soffits of FIG. 14 and of an alternate version of same.

FIGS. 14–17 illustrate cove ceiling soffits which can be created using components of the invention, something not readily achievable in the past. Again, the base plates 10 are the basic component. The additional components include extruded cove base plate adapters 80 shaped as shown in FIG. 15 having a tongue 81, which snaps into either of the base place sockets 14, and a panel retaining lip 82 along its upper edge. Attached to the ceiling by nails or screws are extruded panel ceiling retainers 83, shaped as shown in FIG. 15, having a panel retaining slot 84. Flexible panels 85 are snapped into place between the base plate adapters 80 and the panel ceiling retainers 83, being retained by the lips 82 and the slots 84. The panels 85 can be of any available sheet material, opaque, translucent, even transparent, and of various colors or textures. If translucent, lighting can be installed behind them, thus creating with little effort an almost unlimited number of possibilities for the designer. Since the panels 85 are flexed, bending forces are imposed upon the legs 11 and 15 of the base plates 10. These forces are resisted by molded triangular braces 86 having short, transverse tongues 87 which snap into the base plate connector slots 18, as indicated in FIG. 15.

The curved panels 85 are connected end-to-end by extruded cove ceiling partition strips 90 having a rear spline 91 against which the ends of the panels 85 abut. The front faces of the strips 90 are cut back at each end and the exposed ends of the splines 91 snapped behind the base plate adaptor retaining lips 82 and into the panel ceiling retainer slots 84. A 90° outside corner between a pair of panels 85 is handled by V-shaped extruded, flexible partition strips 95 shown in FIG. 16. The center spline 96 of same includes small flexible flanges 97 which, when forced between the edges of the panels 85, will hold the strips 95 firmly in place. That, coupled with the fact that the strips 95 are formed at a 60° angle rather than at a true 90° angle, assures that the outer wings 98 of the strips 95 will fit tightly against the panels 85 as the wings 98 bend into the curve of the panels 85. A 90° inside corner is accommodated by flexible winged, extruded partition strips 100 shown in FIG. 17 whose center splines 101 also include small flexible flanges 102 for the same purpose as the flanges 97 of the strips 95 and which function in the same manner. Partition strips for handling 45° inside and outside corners would be similar but have different angularity.

If straight panels 105 are desired, they too can be accommodated by the base plate adapters 80 in conjunction with extruded straight panel ceiling retainers 106 having slots 107 for retaining the upper edges of the panels 105. End-to-end connections of the panels 105 would employ connectors similar to the connectors 90 but also having small flexible flanges along their splines, and 90° and 45° inside and outside corners would use partition strips similar to the strips 95 and 100 but having true 90° and 45° angularity.

d. Composition and other Details of the Components

It is contemplated that the longitudinal components of the invention be extruded in 12-foot lengths from a suitable poly-plastic material, such as a rigid polyurethane. These components include the base plates 10, the panels 20 and 35, the I-beam connectors 40, the T-connectors 75, the butt connectors 76, the base plate adapters 80, the cove panel ceiling retainers 83 and connectors 90, and the straight panel ceiling retainers 106. Of the remaining components, the panel braces 30, the I-beam connector braces 50, the butt-end connectors 55 and 56, the corner connectors 60–63, the butt-end connectors 59, 70 and 71, and the braces 86 would be molded of the same rigid material, while the decorative strips 58 and the partition strips 90, 95 and 100 would be extruded from flexible such material, also in 12-foot lengths.

The base plates 10 may be 3 inches in depth and 2 inches in height, the panels 20 14¼ inches wide including the tongues 24, and the panels 35 12⅝ inches wide including the tongues 37. Both panels 20 and 35 may be 3/16 inches thick. The bases 41 of the I-beam connectors 40 may be 1 3/16 inches wide including the tongues 42, and of the same thickness as the panels 20 and 35. The panel braces 20 may be 6⅝ inches long with their tongues 31 3 inches apart (the same as the spacing of the sockets 22 and 36 of the panels 20 and 35), and the I-beam braces 50 4⅝ inches long with their tongues 51 spaced at 2 inch intervals. The corner connections 60–63 may be 14 inches long. The cylindrical ends of the tongues 23, 24, 37, 42, 64, 77 and 81 may be 1/16 inches in diameter, as are the inner ends of their respective sockets 14, 16, 38 and 43, while the tongues 31, 51 and 87, the connectors 59, 70 and 71, and the sockets 18, 22, 36 and 46 may be ⅛ inches in diameter. Other aspects of the components will be apparent from the drawings.

e. Other Applications of the Invention

While the components of the invention have been described in connection with kitchens, they are also readily adaptable to the creation of other facades, decorative as well as functional. A cove ceiling in a dining room, for instance, can be installed simply by cutting off the horizontal legs 15 of the base plates 10 and mounting the latter to the walls. Attaching the base plates 10 to wall cleats and using vertical panels 20 cut so that they do not reach the ceiling will form an inverted cornice for placement of indirect lighting. The decorative base plate inserts 58 could be illuminated for use in the bar area of a home or restaurant. Inverting the base plates 10 and using a reduced width of vertical panel 20 would form a window cornice or valence for blinds or draperies. The opening in a ceiling for a skylight or window can be enclosed by again removing the horizontal legs 15 of the base plates 10, installing them around the vertical faces of the opening, and then using vertical panels 20 upwards to the window. The components of the invention can also be used to provide light-weight, adaptable, low-cost enclosures for pipes, phone cables, air conditioning chases, etc., especially in the case of the remodeling of office buildings.

In short, almost endless structural and decorative uses and arrangements are possible with the basic components of the invention, most if not all avoiding heavy construction, drywalling and the like. Hence, though the invention has been described in terms of particular embodiments, being the best modes of carrying out the invention, it is not limited to those embodiments alone. Thus, the following claims are to be read as encompassing all adaptations and modifications of the invention falling within its spirit and scope.

I claim:

1. A modular componential system for assembling various building interior facade structures, the system comprising:

(a) at least one elongated base member of generally "L-shaped" configuration in cross-section and extruded in its longitudinal direction from plastic material, the legs of the "L" having a pair of first and second outer faces and a corresponding pair of first and second inner faces, the outer faces of the legs abutting each other at a right angle;

(b) at least one elongated vertical panel of generally rectangular shape having outer and inner faces and extruding in its longitudinal direction from plastic material;

(c) first cooperating means at the exterior face of one of the legs of the base member and adjacent one of the logitudinal edges of the vertical panel for snappingly engaging the vertical panel with the base member in order to join one to the other, the first cooperating means being respectively integrally extruded with the base member and the vertical panel and extending the lengths thereof;

(d) at least one elongated panel brace member molded from plastic material and having opposite longitudinal edges; and (e) second cooperating means disposed on the interior face of the vertical panel and on one longitudinal edge of the panel brace member for snappingly engaging the panel brace member with the inner face of the vertical panel such that the panel brace member extends transversely of and is joined to the vertical panel, said second means on the vertical panel extending the length thereof, being integrally extruded therewith and comprising a plurality of means uniformly spaced apart transversely of the vertical panel, said second means on the panel brace member extending transversely thereof, being molded integrally therewith and comprising a plurality of uniformly spaced apart means effective to engage as aforesaid said second means on the vertical panel.

2. The system of claim 1 wherein said one leg of the base member includes a shouldered inset in its outer face extending the length of the base member and to the outer longitudinal edge of said leg effective to receive said one longitudinal edge of the vertical panel so that the outer faces of said leg and the panel are co-planar, and wherein the first cooperating means on the vertical panel comprises a tongue extending at a right angle from the inner face thereof parallel to the longitudinal edges of the vertical panel, the outer edge of the tongue being longitudinally cylindrically enlarged, and wherein the first cooperating means on said leg comprises a socket extending inwardly from said inset towards the inner face of said leg parallel to the longitudinal edges of the vertical panel and longitudinally cylindrically enlarged along its inner end effective to receive said tongue as aforesaid.

3. The system of claim 2 including a pair of said sockets in said inset and spaced apart transversely thereof effective so that when said panel member is engaged with one of the sockets said longitudinal edge of the panel abuts a wall of said insert and when said panel member is engaged with the other of the sockets said longitudinal edge of the panel is spaced from said wall.

4. The system of claim 1 wherein each of the second cooperating means on the inner face of the vertical panel comprises a longitudinally extending socket generally cylindrical in cross-section, and wherein each of the second cooperating means on the panel brace member comprises a relatively short-in-length tongue cylindrically enlarged at its outer edge effective to be received as aforesaid in said socket.

5. The system of claim 1 further including:

(a) at least one elongated vertical/horizontal panel of generally rectangular shape having outer and inner faces and extruded in its longitudinal direction from plastic material, the inner face of the vertical/horizontal panel including duplicates in structure, formation and disposition of said second cooperating means on the inner face of the vertical panel effective to be snappingly engaged by said second cooperating means on the panel brace member;

(b) at least one elongated panel connector of generally "I-beam" configuration in cross-section and extruded in its longitudinal direction from plastic material, the base of the "I" having outer and inner faces, the web of the "I" extending from said inner face;

(c) third cooperating means at the other longitudinal edge of the vertical panel, at the longitudinal edge of the other of the base member legs, at the opposite longitudinal edges of the vertical/horizontal panel and at the opposite longitudinal edges of the base of the "I-beam" panel connector, for respectively snappingly engaging the "I-beam" panel connector between the vertical/horizontal panel with said other edge of the base member in order to join one to the other so that the respective exterior faces thereof are co-planar, the third cooperating means being integrally extruded with each of the vertical panel, the base member, the vertical/horizontal panel and the "I-beam" panel connector and extending the lengths thereof;

(d) at least one elongated panel connector brace member molded from plastic material and having opposite longitudinal edges; and (e) fourth cooperating means disposed on one longitudinal edge of the panel connector brace member and on the top of the web of the "I-beam" panel connector for snappingly engaging the panel connector brace member with the "I-beam" panel connector and with the vertical and the vertical/horizontal panels when the "I-beam" panel connector is joined between the vertical panel and the vertical/horizontal panel as aforesaid, the panel connector brace member extending transversely of the "I-beam" panel connector and the interior faces of the vertical and the vertical/horizontal panels in order to join the panel brace member thereto, said means on the top of the "I-beam" panel connector being integrally extruded therewith and extending the length thereof, said means on the panel connector brace member extending transversely thereof, being molded integrally therewith and comprising a plurality of transversely spaced apart means effective to engage as aforesaid said means on the top of the "I-beam" panel connector and said second means on the interior faces of the vertical and the vertical/horizontal panels.

6. The system of claim 5 wherein each of the third cooperating means comprises a tongue extending longitudinally along and from one of said edges of the vertical panel, of the vertical/horizontal panel and of the base of the "I-beam" panel connector in the respective planes thereof, each of said tongues being cylindrically enlarged at its outer edge, and a socket extending inwardly from and longitudinally along the other of said edges of the vertical panel, of the vertical/horizontal panel and of the base of the "I-beam" panel connector in the respective planes thereof, the inner end of each of said sockets being cylindrically enlarged effective to receive one of said tongues as aforesaid.

7. The system of claim 6 wherein each of the fourth cooperating means at the top of the panel connector brace member comprises a longitudinally extending socket generally cylindrical in cross-section, and wherein each of the fourth cooperating means on the panel connector brace member comprises a relatively short-in-length tongue cylindrically enlarged at its outer edge effective to be received as aforesaid in said socket.

8. A structural system for building interior facades, the system being composed of modular components and comprising:

(a) at least one elongated base member of generally "L-shaped" configuration in cross-section and extruded in its longitudinal direction from plastic material, the legs of the "L" having a pair of first and second outer faces and a corresponding pair of first and second inner faces, the outer faces of the legs abutting each other at a right angle;

(b) a shouldered inset in the outer faces of one leg of the base member extending the length thereof and to the outer longitudinal edge of said leg, said inset having a first wall parallel to the outer face of said one leg and a second wall forming a right angle with said first wall;

(c) a pair of parallel sockets in said first inset wall extending the length of the base member and inwardly from said first wall, said sockets being also parallel to said second inset wall and cylindrically enlarged along their inner ends;

(d) an elongated base member panel adapter of generally rectangular shape in cross-section having a pair of opposite parallel outer and inner faces and a pair of opposite edge faces, the panel adapter being extruded in its longitudinal direction from plastic material, the panel adapter being disposable in said inset so that the outer faces of said leg and the panel adapter are co-planar, said inner face of the panel adapter having a tongue extending at a right angle therefrom parallel to the longitudinal edges of the panel adapter, the outer edge of the tongue being cylindrically enlarged effective to snappingly engage one of said sockets in the inset of the base member in order to retain the panel adapter in said inset as aforesaid, the inner face of the panel adapter also having a right-angled shouldered inset laterally disposed from said tongue and extending the length thereof and to one of said opposite edge faces effective to provide a panel retaining seat between the panel adapter and said first wall of the base member inset when the panel adapter is dispose therein as aforesaid;

(e) an elongated panel ceiling retainer extruded in its longitudinal direction from plastic material, the panel ceiling retainer having a panel retaining seat therein extending the length thereof; and (f) an elongated panel rectangular in plain view and extruded in its longitudinal direction from plastic material, the panel having opposite longitudinal edges respectively fittable in the panel retaining seat provided by the base member panel adapter and in the retaining seat in the panel ceiling retainer.

9. The structural system of claim 8 wherein said panel is formed of flexible material.

10. A component of a modular componential system for assembling various building interior facade structures, the component comprising:

(a) an elongated base member of generally "L-shaped" configuration including a first leg and a second leg in cross-section and extruded in its longitudinal direction from plastic material, the first and second legs of the "L" having a pair of first and second outer faces, respectively, and a corresponding pair of first and second inner faces, the outer faces of the legs abutting each other at a right angle;

(b) a shouldered inset in an upper portion of the outer face of the first leg of the base member extending the length thereof and to the outer longitudinal edge of said leg, said inset having a first wall parallel to the outer face of said first leg and a second wall forming a right angle with said first wall;

(c) means in said inset extending the length of the base member for retaining a panel in said inset so that a face of the panel is co-planar with the outer face of said first base member leg; and (d) means disposed on said pair of first and second inner faces of said legs of said elongated base member for attaching braces between said legs to resist bending forces imposed on the legs.

11. The component of claim 10 wherein said means for retaining a panel in said inset includes at least one socket in said first inset wall extending inwardly thereof and cylindrically enlarged at its inner end.

12. The component of claim 11 including another socket in the outer edge of the horizontal leg of said legs extending longitudinally the length thereof parallel to the first socket and cylindrically enlarged at its inner end.

13. The component of claim 12 wherein the means disposed on said pair of first and second inner faces of said legs of said elongated base member for attaching braces between said legs includes a pair of parallel sockets extending longitudinally of said elongated base member along and from the inner faces of said legs parallel to the first socket and cylindrically enlarged at their inner ends adapted to receive transverse tongues of said braces.

14. The component of claim 13 including a slot through said first leg adjacent the juncture between said legs, the slot extending longitudinally the length thereof parallel to said sockets and opening through the ends of said leg.

* * * * *